US011004633B1

(12) United States Patent
Lellis Junior et al.

(10) Patent No.: US 11,004,633 B1
(45) Date of Patent: May 11, 2021

(54) THREE-POLE POLYMERIC SWITCH HAVING COMMAND AND PROTECTION ELECTRONICS INTEGRATED INTO A STANDALONE DEVICE

(71) Applicants: Celso Garcia Lellis Junior, Santana de Parnaíba (BR); Ayres Antonio de Paes de Oliveira, Santana de Parnaíba (BR)

(72) Inventors: Celso Garcia Lellis Junior, Santana de Parnaíba (BR); Ayres Antonio de Paes de Oliveira, Santana de Parnaíba (BR)

( * ) Notice: Subject to any disclaimer, the term of this patent is extended or adjusted under 35 U.S.C. 154(b) by 0 days.

(21) Appl. No.: 16/673,570

(22) Filed: Nov. 4, 2019

(51) Int. Cl.
*H01H 33/666* (2006.01)
*H01H 33/12* (2006.01)
*H01H 33/02* (2006.01)

(52) U.S. Cl.
CPC ..... *H01H 33/6661* (2013.01); *H01H 33/022* (2013.01); *H01H 33/125* (2013.01)

(58) Field of Classification Search
CPC . H01H 33/6661; H01H 33/022; H01H 33/125
See application file for complete search history.

(56) References Cited

U.S. PATENT DOCUMENTS 5,128,502 A * 7/1992 Hux ..... H01H 33/008 218/153
5,508,486 A * 4/1996 Spack ..... H01H 33/6661 218/3
5,510,590 A * 4/1996 Hux ..... H01H 9/563 218/153

FOREIGN PATENT DOCUMENTS

BR 202016026087 * 10/2018

* cited by examiner

*Primary Examiner* — Jared Fureman
*Assistant Examiner* — Duc M Pham
(74) *Attorney, Agent, or Firm* — B. Aaron Schulman, Esq.; Stites & Harbison, PLLC

(57) ABSTRACT

A three-pole polymeric switch with command and protection electronics integrated into a standalone device, wherein the medium voltage interruption element, the command, control and power supply circuits are self-powered by the primary network and installed in the potential. Protection, sectioning, fault indication and communication functions are integrated into the standalone device for use both as an automation device integrated into control centers, and as a protection device against transient currents from short-circuits. The device makes it possible to either reduce the interruption time of electric circuits, thus reducing interruptions during transient events, or isolate stretches when permanent events occur. The device contains a long-range communication radio, allowing long-distance communication by sending its status to control centers, reducing the time required for identifying problematic overhead distribution sections. The device's low cost, low weight and easy installation enables the expansion of automatic control and supervision solutions of overhead electric power distribution lines.

14 Claims, 8 Drawing Sheets

Block Diagram

THREE-POLE POLYMERIC SWITCH HAVING COMMAND AND PROTECTION ELECTRONICS INTEGRATED INTO A STANDALONE DEVICE

FIELD OF THE INVENTION

The present invention relates generally to devices used in overhead electric power distribution systems.

BACKGROUND OF THE INVENTION

Currently, the overhead power lines which are widely used as an electric power distribution device have some problems caused by vegetation and climatic events that result in transient short-circuits, thus causing constant power interruptions. The direct consequence to power energy distributors is the worsening of the quality standards for consumers, as well as high maintenance and operation costs. The constant outages represent a great inconvenience to consumers.

The state-of-the-art uses two main types of automation equipment to mitigate the problems in overhead electric power distribution lines: recloser and load break switches. This equipment is currently the only solution that addresses such problems and is installed both in overhead lines and medium voltage substation feeders. However, the current solution is too expensive, requires a high maintenance rate and involves products constructed under the same principles as those used 40 to 50 years ago.

Before the creation of so-called "vacuum interrupters" and for a long time after its introduction into the market, the switches were isolated by SF6 gas, causing huge environment-related problems, besides being a fail point in equipment that needed sensors for monitoring the pressure of arc extinguisher tanks, and a periodic isolating gas exchange program to guarantee its functioning. The same occurred with insulation oils that required periodic inspection of the insulation conditions thereof in specialized laboratories and suffered from problems generated whenever the oil absorbed water, thus decreasing the insulation properties. The introduction of the vacuum interruption technology by means of glass or ceramic ampoules was an innovation that brought many benefits in the use of the equipment, thus solving the environment-related problems and eliminating the need for frequent maintenance or complex systems for monitoring and discarding oil and/or gas.

The benefit of vacuum interrupters is the use of a vacuum as an insulation element, ensuring high insulation. They are also composed of tiny elements, making it easy to create lighter and smaller switches. They are associated with mechanical sets called "magnetic actuators" which are responsible for the closing and opening operations.

However, this innovation has generated some limitations in its use, that is, it demands some characteristics in the construction of the solution that can be better addressed nowadays by other forms of implementation. The principle behind vacuum interrupters is that there is a significant pressure difference between the interruption element and the environment in which the magnetic actuator is installed. Moreover, the insulation of inner and outer components is attained by using metallic foils, allowing the mechanical movement of the contacts thereof.

FIG. 1 is a schematic view of a switch using the traditional vacuum interrupters. It shows the electric contacts (1), the electric current output contact (2), the closing metallic cover (3), the vacuum insulation (4), the ceramic/glass ampoule (5), the movement foil (6), the inside closing metallic cover (7), the magnetic actuator (8) and the opening spring (9).

The electric contacts are closed by moving the axle of the magnetic actuator (8) in the direction indicated in the figure (upwards). During the movement, the actuator stores mechanical power in the opening spring (9) that will be used in the process to open the contacts. The contacts open in the reverse direction (downwards). For that purpose, the magnetic actuator moves its axle using the magnetic power of its plunger associated with the mechanical power stored in the opening spring. This occurs because of the high power associated with the high opening speed while the current is interrupted, in order to overcome the pressure differential between the internal vacuum (P0) and the outside atmospheric pressure (P1), and interrupt the voltaic arc as soon as possible.

Therefore, the principle of the current vacuum interruption systems is that they must necessarily have enough power to overcome the inner/outer pressure difference to which the ampoule is subjected, on top of the natural resistance of the mechanical foil that imposes another limitation: the opening and closing speed of the interrupting element. As an example, a magnetic actuator requires 60 kgF to close a single 15 kV/630 A vacuum interrupter per pole.

The practical result herein is that the construction of medium voltage equipment requires a lot of power to work. Some typical solutions used are large electrolytic capacitors and batteries to store and supply energy for opening and closing operations.

This makes the electric power line automation and protection equipment complex and expensive, requiring panels, metallic boxes, axles, springs and a huge number of mechanical elements to operate. All of this represents costs and fail points and maintenance fees that limit their large-scale use.

Another complicating factor in this solution is the need to use batteries for maintaining the required power to operate state-of-the-art equipment because of its high consumption. Batteries are items that require periodic maintenance and they are not reliable since they cannot be monitored easily, even when carrying out constant maintenance routines. The use of batteries is becoming a huge problem for power distributors because the amount of automation equipment is increasingly spreading over the electric power lines.

The state-of-the-art recloser and load break switches are constituted of two distinct parts: the power unit (circuit-breaker) and the controller element (protection relay, and powering and driver system) which are connected by an electric wire. They are housed in a metallic cabinet, resulting in a highly complex and high weight end product that uses several different materials for the construction thereof. As an example, the weight of a typical 15 kV recloser is about 120 kg and its controller is in the 60 kg range.

The present invention provides technical solutions fora large number of limitations and problems exhibited by state-of-the-art products.

SUMMARY OF THE INVENTION

The present invention is a three-pole polymeric switch with command and protection electronics integrated into a standalone device. The proposed device uses a new concept in which both the medium voltage interruption element and the command and protection electronics are integrated into a standalone polymeric device which is self-powered by the primary electric power distribution line and installed in the potential.

Said interruption element is encapsulated into an injected polymeric device assembled on a polymeric bar, making out a low-cost, low-weight, three-phase equipment which can be used for switching automation or protection of electric power distribution lines in the place of existing equipment, or even for use in electric power line substation feeders. The advantages of this equipment include the drastic reduction both in cost and weight, and the integration of communication elements through radiofrequency or fiber optics technology incorporated into the product.

The device can be provided with two distinct forms of mechanical actuation As described in patent number BR 10 2016 024353-0 entitled "BI-STABLE CLOSED FIELD ELECTROMAGNETIC ACTUATOR WITH EXTERNAL COIL AND VACUUM INTERRUPTER", which is owned by two of the authors of this patent and incorporated herein by reference, the device can incorporate a bi-stable magnetic actuator connected to a conventional vacuum switch (Vacuum Interrupters), or a mechanical actuation system made out by a magnetic bi-pole assembled to the same electric contact environment, where both elements are subjected to the same barometric pressure described in the present patent.

The use of the bi-stable magnetic actuator described in patent number BR 10 2016 024353-0, incorporated herein by reference, overcomes some of the limitations of the state-of-the-art products as it has dispensed with the use of springs as an aid so that the mechanical movement can open the contacts, since the use of rare earth magnets associated with a differentiated mechanical shape has resulted in a product that requires little energy to be actuated, large resistance and high speed. For comparison, for each actuation a typical state-of-the-art magnetic actuator uses about 105 Joules, while the bi-stable actuator referred to herein uses only 15 Joules.

This constructive characteristic has allowed the development of a three-phase breaker solution that uses supercapacitors instead of batteries to actuate the device, making it possible to be used in medium voltage distribution lines, preventing the use of ancillary current transformers, and making it possible to assemble the set into a standalone polymeric device, thus reducing its complexity and eliminating corrosion and wear problems.

Regarding the polymeric device, either the base box or the respective insulation bushings of the present invention use an innovative resin manufactured by Celanese®, whose composition assures its physical and chemical integrity for a period of 30 years. Both parts are injected at high pressure, ensuring high repeatability, low production loss, low weight and reduced use of material.

This new manufacturing approach represents an undeniable evolution when compared to bicomponent resins used in state-of-the-art equipment, which are injected at low pressure, causing several industrial losses that come from the formation of bubbles and the use of a large amount of polymeric material, thus resulting in high weight and cost. Moreover, the productivity of the injection process at low pressure is much less than those at high pressure, requiring cure times of about a few days.

Concomitantly, an electronic set composed of a CPU, a self-powered system, a 900 MHz radio with RF MESH or Point—MultiPoint technology and a transceiver for fiber optics carry out the control, protection and communication functions of the interruption element, allowing the remote management and integration thereof to smart electric power distribution lines.

The powering of the whole set is provided by a Current Transformer (CT) with a high-output "coil/ampere" nanocrystalline core that converts the current passing through the electric power distribution line wires into voltage with the support of a set of photovoltaic panels coupled to the upper side of the polymeric bar. Said powering set proceeds by charging a set of supercapacitors designed to supply the required power, either for actuating the devices that open and close electric contacts, or for powering the command electronics responsible for the management of the functionalities of the equipment.

The whole set is composed of three interrupting elements and an electronic module which are integrated into a polymeric bar and make out a complete three-phase interrupting equipment, thus dispensing with the use of external control panels. This device can be used to replace recloser switchgears and automated switches in overhead electric power distribution lines, or to replace circuit-breakers in medium voltage substation feeders of 15 kV or 27 kV. It was developed to support rated currents of 530 A to 800 A, with interruption levels of 12.5 kA to 20 kA (as a function of the dimensions of its components), thus making it possible to use the device in the main branches of electric power distribution lines. After being constructively modified, this same device can be used as an interruption element in medium voltage cubicles instead of the traditional three-phase switches, resulting in reduced weight, dimension and cost compared to the current solutions.

DETAILED DESCRIPTION OF THE INVENTION

The present invention is a three-pole polymeric switch with command and protection electronics integrated into a standalone device, wherein the medium voltage interruption element, the command, control and power supply circuits are self-powered by the primary network and installed in the potential. Protection, sectioning, fault indication and communication functions are integrated into the standalone device for use both as an automation device integrated into control centers, and as a protection device against transient currents from short-circuits. The device makes it possible to either reduce the interruption time of electric circuits, thus reducing interruptions during transient events, or isolate stretches when permanent events occur. The device contains a long-range communication radio, allowing long-distance communication by sending its status to control centers, reducing the time required for identifying problematic overhead distribution sections. The device's low cost, low weight and easy installation enables the expansion of automatic control and supervision solutions of overhead electric power distribution lines.

The accompanying Figures describe the product in detail. However, their ratios are mere references and may be changed in order to fully satisfy the requirements of the device.

Figure 1:
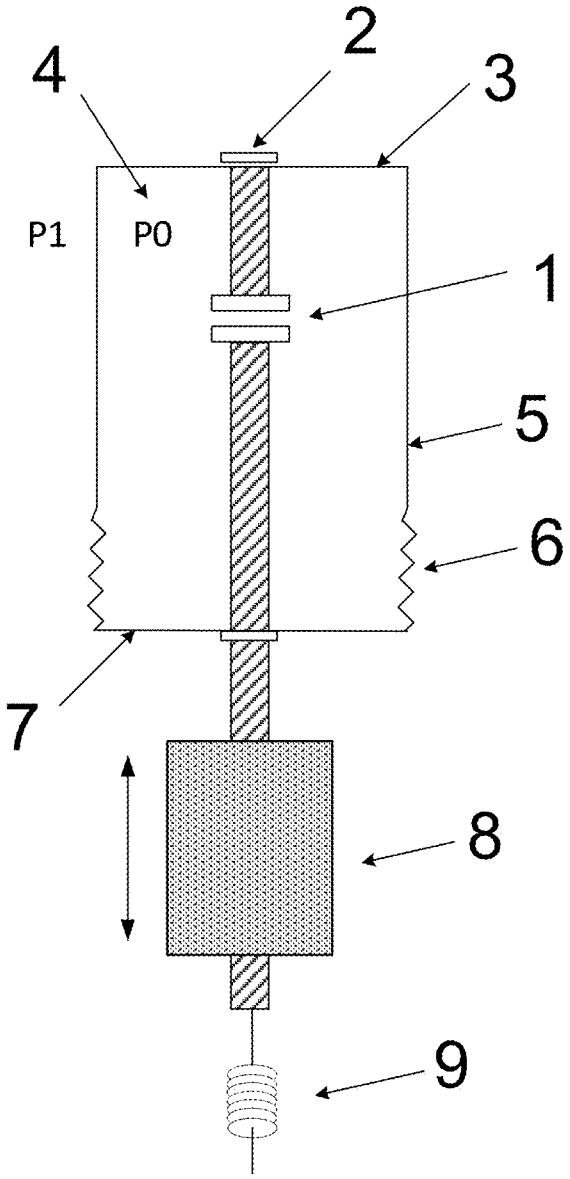
Fig. 1 PRIOR ART
FIG. 1 a schematic view of a switch using the state-of-the-art vacuum interrupters.
Figure 2:
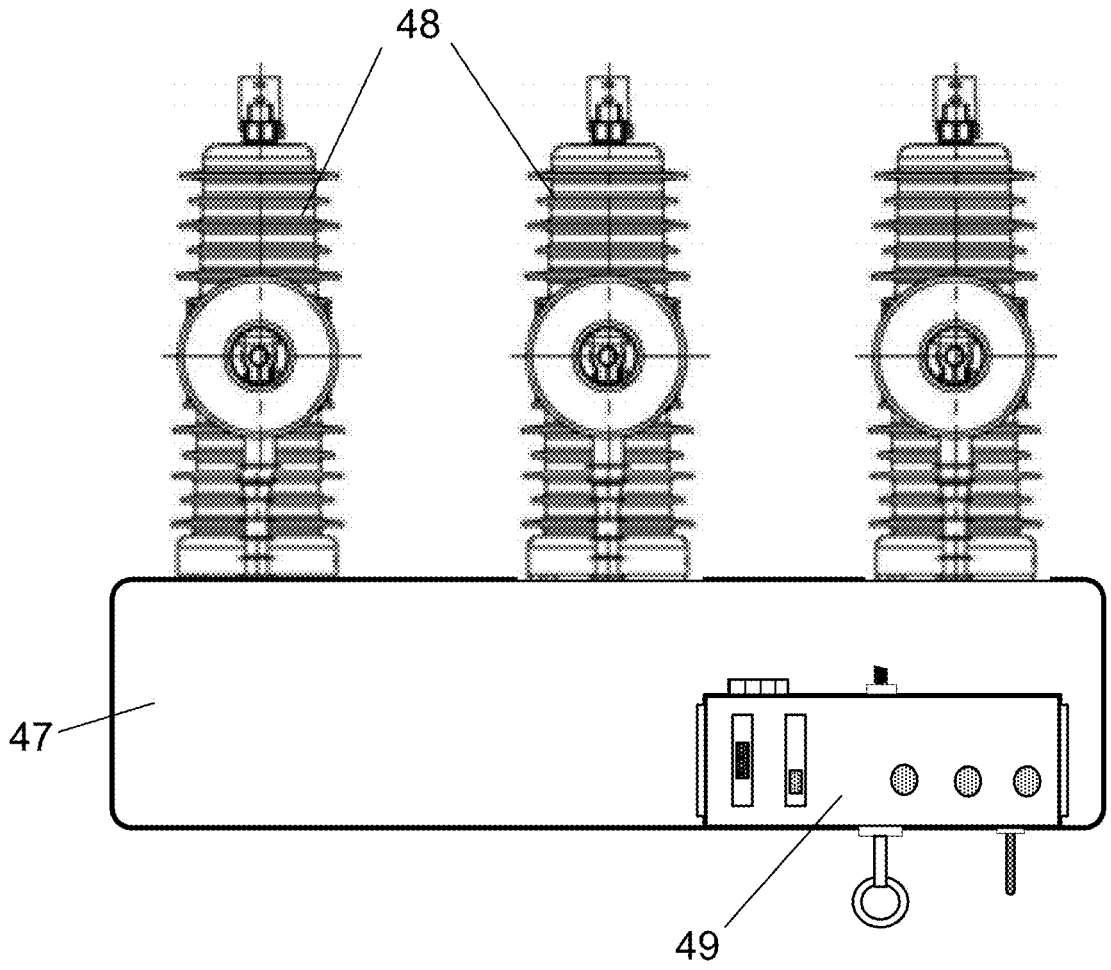
FIG. 2 is a front view of the assembled device comprising three polymeric insulation bushings, a polymeric base box and an electronic command, control and communication box.
Figure 3:
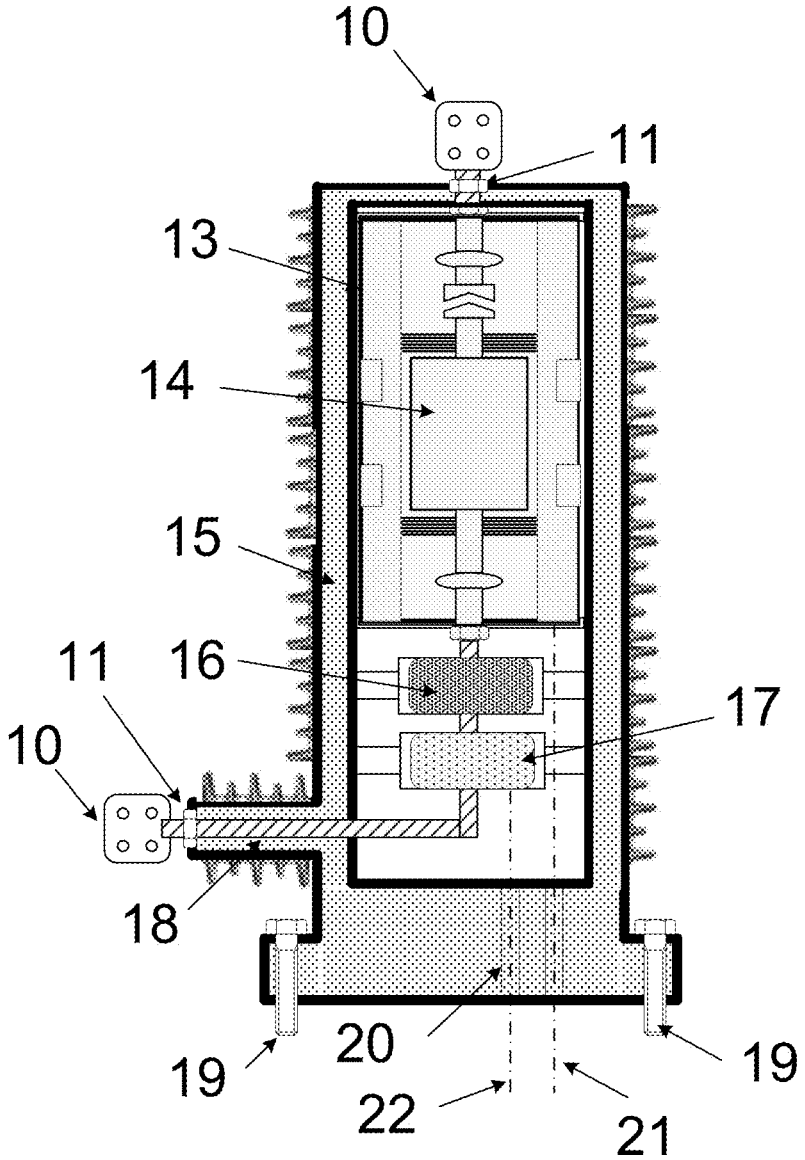
FIG. 3 is a cut view of one of the polymeric insulation bushings.

FIG. 2 represents a front view of the device, showing the final assembly which includes 3 polymeric insulation bushings (48), the polymeric base box (47) and the electronic command, control and communication box (49);

FIG. 3 represents a cut view of the insulation bushing into which the actuating and interrupting element is embedded. The actuating and interrupting element can be either the actuating system that uses the bi-stable magnetic actuator connected to a traditional "vacuum interrupter", or the actuating element already integrated into the switch, both in a vacuum, described in patent number BR 10 2016 024353-0, which is incorporated herein by reference. Element (14) indicated in FIG. 3 is a schematic representation of the "Vacuum Interrupter+actuators" set.

FIG. 3, in addition to the constructive detail above, shows the terminals for the electric current wires (10), the connecting thread of the terminals (11), the actuating and interrupting element (14) of patent number BR 10 2016 024353-0, incorporated herein by reference, the insulation silica sleeve (13), the insulation fastening bushing (15), the metering current transformer (16), the self-power current transformer (17), the main conducting axle (18), the ducts for passing command and signal wires (20), the command wires (21), the signal wires (22) and the screws for the polymeric box (19).

Figure 4:
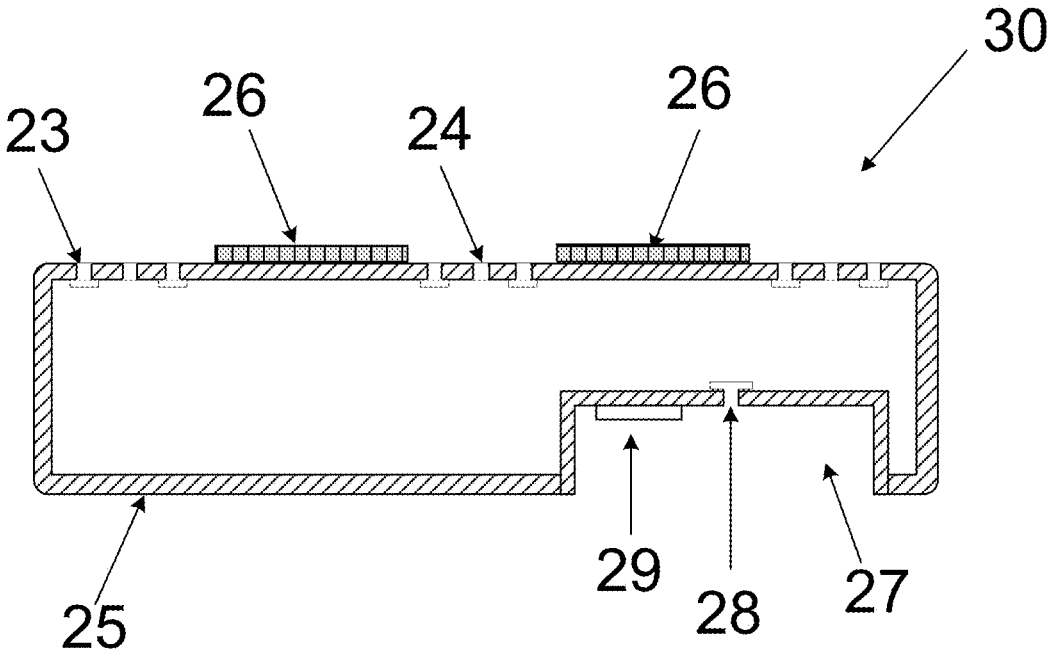
FIG. 4 is a front view of the polymeric box.
Figure 5:
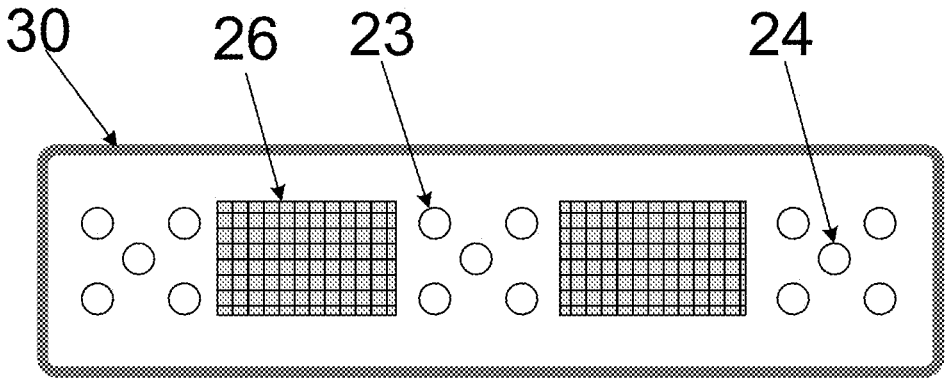
FIG. 5 is a top view of the polymeric box.

FIG. 4 is a front view and FIG. 5 is a top view of the polymeric box (30) showing the ancillary photovoltaic cells (26), the metallic inserts for attaching the insulation bushings (23), the holes for passing the signal and command wires (24), the cavity for attaching the electronic command, control and communication box (27), the interconnecting electric connector (29) and the attachment insert of the electronic command, control and communication box (28).

Figure 6:
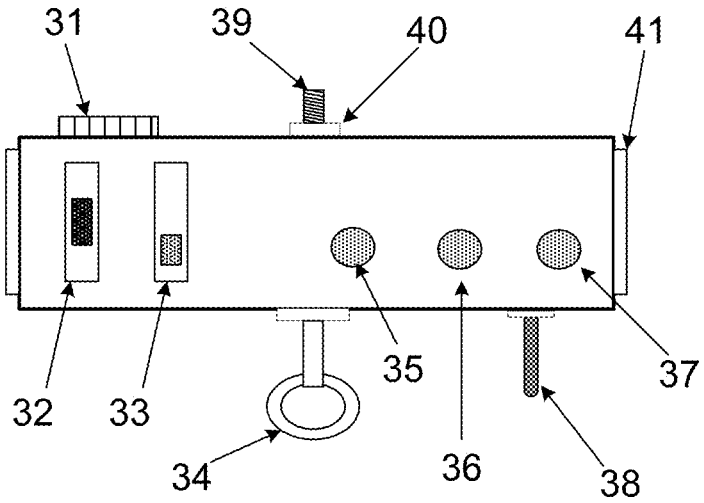
FIG. 6 is a front view of the electronic command, control and communication box.
Figure 7:
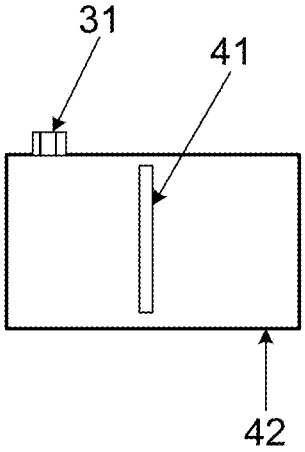
FIG. 7 is a side view of the electronic command, control and communication box.
Figure 8:
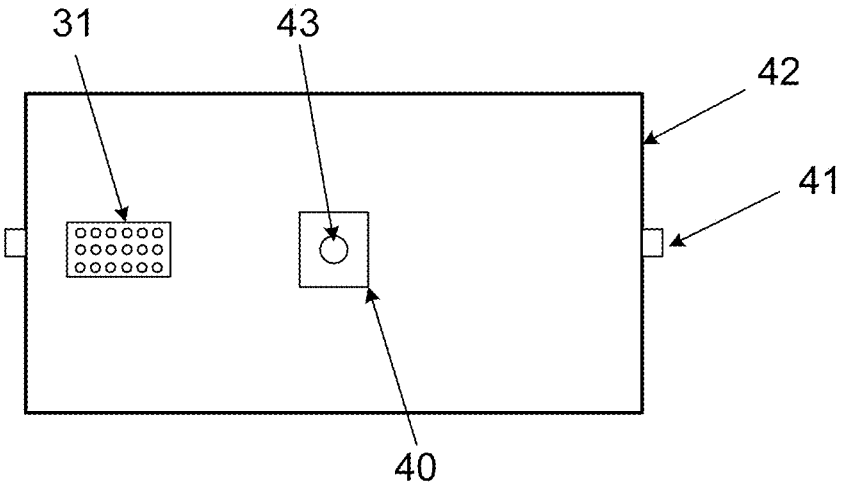
FIG. 8 is a top view of the electronic command, control and communication box.
Figure 9:
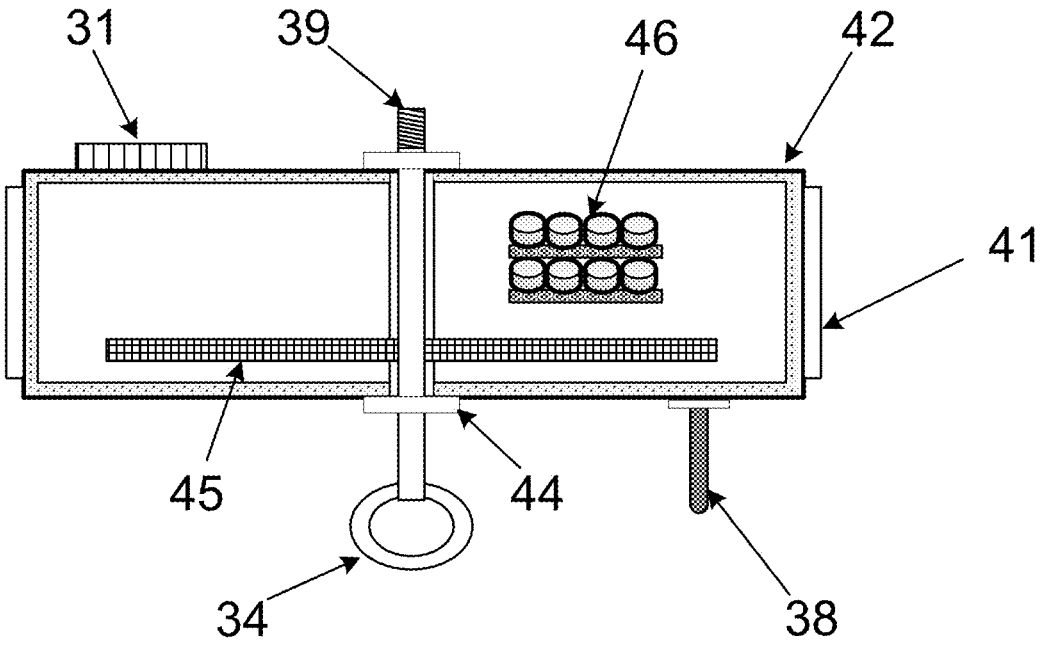
FIG. 9 is a cut view of the electronic command, control and communication box.

FIG. 6 is a front view, FIG. 7 is a side view, FIG. 8 is a top view, and FIG. 9 is a cut view of the electronic command, control and communication box. FIG. 6 shows the blocking lever (32), the command lever (33), the connector (31), the attachment pin (39), the stud washer (40), the status LED (35), the blocking LED (36), the operation LED (37), the RF antenna (38), the attachment eyelet (34) and the guides (41). FIG. 7 shows the air-tight metallic electronics box (42), the guides (41) and the connector (31). FIG. 8 shows the air-tight metallic electronics box (42), the guides (41), the connector (31), the stud washer (40) and the through-hole of the attachment pin (43). FIG. 9 shows the connector (31), the attachment pin (39), the supercapacitors bank (46), the air-tight metallic box (42), the guides (41), the electronic board (printed circuit board) (45), the stud washer (44), the attachment eyelet (34) and the RF antennas (38).

Figure 10:
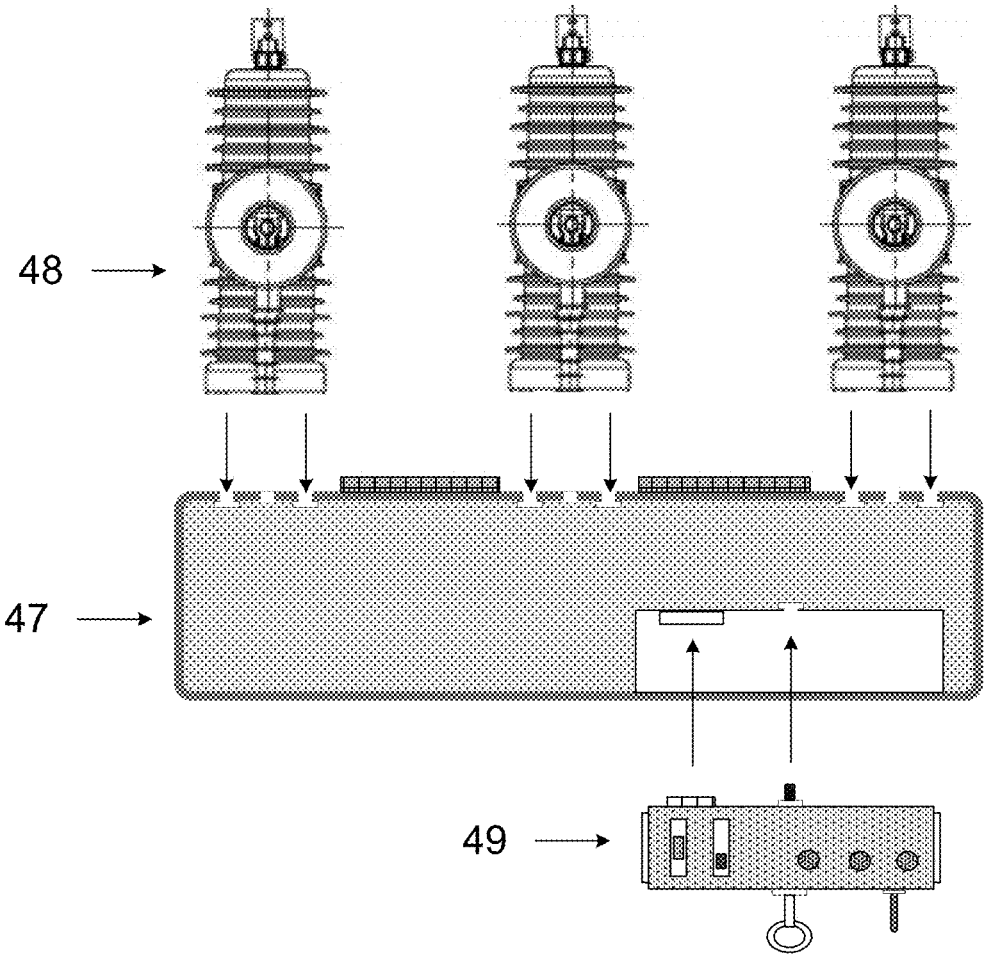
FIG. 10 is front view of the device demonstrating how the device is assembled.

FIG. 10 shows where the insulation bushings (48) and the electronic box (49) attach to the polymeric box (47) as indicated by the arrows.

Figure 11:
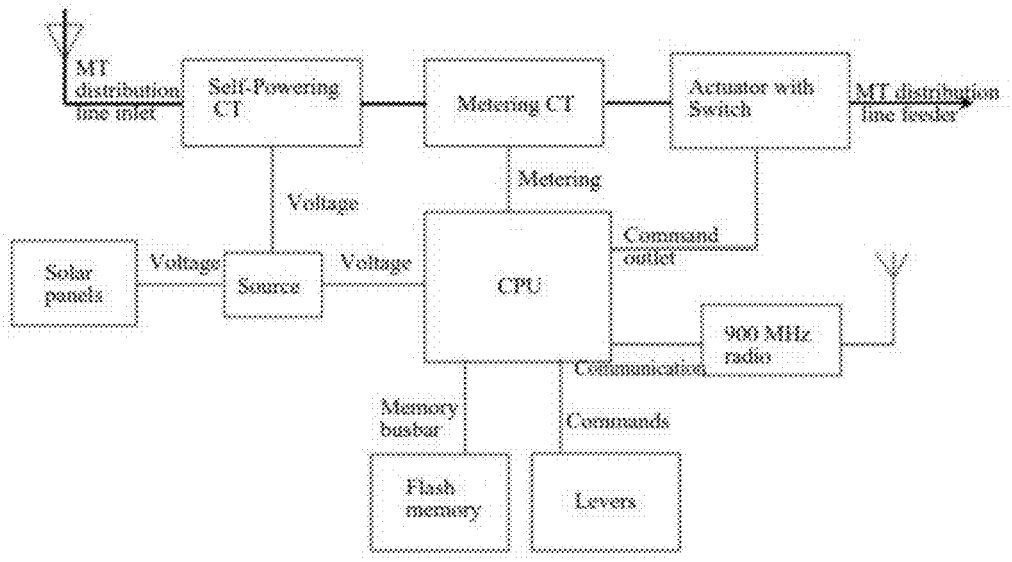
FIG. 11 is a block diagram of the main parts and how they interact with one another.

FIG. 11 is a block diagram showing the main parts of the device and how they interact.

The device presented herein derives from the principle of use of the patent filed under number BR 10 2016 024353-0, incorporated herein by reference, which solves the problems related to the need for high power for switching interruption elements. Patent number BR 10 2016 024353-0, entitled "BI-STABLE CLOSED FIELD ELECTROMAGNETIC ACTUATOR WITH EXTERNAL COIL AND VACUUM INTERRUPTER" and incorporated herein by reference, describes two products that can be used individually. The first product describes a bi-stable closed field magnetic actuator, whose actuating coils are external to the ferromagnetic body, using a magnetic bi-pole to activate the vacuum interruption element coupled to it. This magnetic actuator, due its constructive characteristics, uses the magnetic force as a movement element, dispensing the need to storage mechanical power in a spring. The second product described in the same patent describes a fully polymeric standalone element, where the interruption contacts and the bi-stable closed field magnetic actuator, responsible for the mechanical actuation, are submitted to the same vacuum environment. Both solutions bring about huge advantages as they drastically reduce the energy required for opening and closing operations.

The actuation and interruption elements described in patent BR 10 2016 024353-0, which is incorporated herein by reference, are inserted into a polymeric bushing (FIG. 3), allowing the parts to be assembled externally and integrated into a polymeric box (FIGS. 4 and 5) into which all required electronics for the operation thereof are installed (FIGS. 6, 7, 8 and 9), including the control, actuation and communication electronics. As mentioned previously, the principle of functioning of the devices of patent BR 10 2016 024353-0, which is incorporated herein by reference, makes it possible to mechanically shape the parts as a function of the amount of energy required for its mechanical movement, that opens and closes electric contacts.

This results in a standalone polymeric device (FIG. 2), weighing about 25 kg, containing all the required elements for its operation. It can be connected with the operation centers of power distribution companies through radio-frequency, this radio having been integrated into the device, allowing it to be operated remotely. Because of its low power consumption due to its constructive principle, it does not need batteries and can be powered by the energy of the primary circuit when installed at the potential, or a low voltage powering. This same solution can be installed in the medium voltage line substations feeders, playing a role that is identical to that of the existing circuit-breakers, but counting on its integrated protection, command and communication electronics.

The actuation and interruption elements described in patent BR 10 2016 024353-0, which is incorporated herein by reference, are inserted into a high-pressure injected polymeric bushing (FIG. 3) using a highly insulated resin which possesses all the chemical/physical characteristics required to satisfy this application. Using high-pressure injection technology over the traditional bicomponent resins that are injected at atmospheric pressure by gravity and used in state-of-the-art solutions results in a product with a better repeatability in view of the fact that it is a bubble free process of higher productivity and low weight, thus causing direct impact on the reduction of production costs. Its low weight is due to the high dielectric resistance of 33.5 kV/mm, compared to the 20.0 kV/mm resistance of traditional bicomponent resins, in addition to a higher mechanical resistance, thus making it possible to produce insulated bushings having a 3.0 mm thickness wall compared to the 21.0 mm of bicomponent resins.

In a polymeric box (FIGS. 4 and 5), three bushings (FIG. 3) contain their respective interruption elements (14), current detectors (16) and self-powering current transformers (17), from which a small conductor for sending the electric actuation command (21) extends, in addition to one for sending the phase current signal (22). This polymeric box (FIGS. 4 and 5) houses a pair of solar panels (26) and the removable control panel (FIGS. 6, 7, 8 and 9) that contains the electronic command, control and communication set which is composed of a PCB—"printed circuit board" (45) with an ultra-low power CPU, a 900 MHz radio communicator, a power source based on supercapacitors, in addition to open/close (32) and blocking (33) levers. Since the power consumption for the mechanical actuation is minimal, the electronic set has reduced dimensions. This electronic set is connected to the polymeric box (FIGS. 4 and 5) by a fast coupling connector (31) and uses an endless screw (39) with a lifting eyelet (34) as the attachment element, making it easy for maintenance in the field using only an electrician tool called a "hot stick", which allows the device to be coupled to the lifting eyelet (34) and to be screwed to the polymeric box (FIGS. 4 and 5) directly from the ground without needing to use overhead baskets or stairs.

The powering of the device is assured by the use of a nanocrystalline core CT (16) that supplies the energy required for operating the whole electronic command, control and communication box (FIGS. 6, 7, 8 and 9) and supplies the power to be stored by the bank of supercapacitors (46), which is required to operate the set to execute the functions that open and close electric contacts and to keep it working even when the medium voltage circuit is deenergized. This set of supercapacitors must be previously charged with external low voltage auxiliary power and must keep the control box operating when installed in the electric power distribution line. A set of photovoltaic cells/panels (26) ensures the supply of power required for its operation and communication over a long period of time, even in conditions where the medium voltage circuit is interrupted.

The complete device is composed of a standalone polymeric device connected to a control module in a small polymeric box, without the need of external control panels, batteries, interconnection wires, or any other element. The device was designed to be easily installed on the side of crossarms of overhead power distribution poles in the same way conventional reclosers are installed. In cases where the device will be installed at the potential, no additional lightening arresters are required, and grounding points are not provided either. Similarly, the device could be installed in substations and contemplate a remote interface as an accessory, provided with display and buttons whose communication will be carried out through a radio integrated into the control module, or a fiber optical cable.

As the device is made of high-pressure injected polymeric resins, it does not need finishing painting, surface treatment of any kind, or even additional mechanical protection. The product can be installed in saline or highly damp areas since it does not suffer from the constant oxidation problems that are so common in outdoor products. Its embedded electronics are mounted in an impervious damp free metallic box, which results in a better environmentally preserved accommodation.

The device's configuration is provided by software that is connected by an integrated radio so that its configuration and adjustments can be carried out locally or remotely by the telecommunications system. Two polymerics levers installed in the control module allow same to be opened and closed manually, and blocked digitally. These levers have electromagnetic couplings and do not have axial axles, thus ensuring that the control module and protection module is fully impervious.

Thus, the device fully replaces the existing medium voltage three-phase recloser switchgears, automatized switches and circuit-breakers, with the benefits of low cost, reduced weight, low maintenance and ease of installation. This same device could be used as an interrupting circuit for medium voltage cubicles instead of the existing three-phase switches, with the same advantages presented herein.

The basic functions to be carried out by the three-pole polymeric switch having command and protection electronics integrated into a standalone device are:

1) Identification of electric power distribution line transients, differentiating fault currents from "inrush" currents, thus making it possible to adjust actuation versus current curves over time;

2) Configuration to operate as an automatic sectionalizer upstream to a conventional recloser, allowing the configuration of actuating currents, as well as the number of cycles for the actuation;

3) Fault identification, allowing the detection of transitory faults or permanent faults, both locally and remotely;

4) Actuation as a load break switch, receiving telecommand signals from Control Centers; and 5) Integration to a low power consumption and higher sensitivity and coverage radio at a 900 MHz unlicensed frequency, operating as a communication module in client or repeater mode.

The invention claimed is:

1. A standalone device for overhead medium voltage electric distribution networks comprising:

a. a three-pole polymeric switch;

b. a polymeric base box; and c. an electronic command, control and communication box, wherein the device is self-powered by a primary distribution line and installed at a potential;

wherein the device integrates protection, switching, fault indication and communication functions; and wherein the three-pole polymeric switch comprises three insulation bushings, each insulation bushing further comprising:

a. an actuating and interrupting element;

b. terminals for electric current wires;

c. a connecting thread of the terminals;

d. an insulation silica sleeve;

e. an insulation fastening bushing;

f. a metering current transformer;

g. a self-power current transformer;

h. a main conducting axle' i. command wires;

j. signal wires;

k. ducts for passing the command and signal wires; and l. a set of screws for the polymeric base box.

2. The device according to claim 1, wherein the actuating and interrupting element a bi-stable closed field magnetic actuator connected to a vacuum interrupter, or a polymeric standalone element in which a bi-stable closed field magnetic actuator with interruption contacts is submitted to a vacuum environment.

3. The device according to claim 1, wherein the polymeric base box further comprises:

a. photovoltaic cells;
b. inserts for attaching the insulation bushings;
c. holes for passing the signal and command wires;
d. a cavity for attaching the electronic command, control and communication box;
e. an interconnecting electric connector; and
f. an attachment insert of the electronic command, control and communication box.

4. The device according to claim 1, wherein the electronic command, control and communication box is an air-tight metallic box that further comprises:

a. a blocking lever;
b. a command lever;
c. a connector;
d. an attachment pin;
e. a through-hole of the attachment pin;
f/ a first stud washer;
g. a second stud washer;
h. a status LED;
i. a blocking LED;
j. an operation LED;
k. an RF antenna;
l. an attachment eyelet;
m. a set of guides; and
n. a printed circuit board with an ultra-low power CPU, a 900 MHz radio communicator, and a supercapacitors bank; and wherein the attachment pin is actuated by the eyelet, allowing the electronic command, control and communication box to be installed and removed directly from land by a hot stick.

5. The device according to claim 4, wherein the blocking lever and the command lever are actuated by magnetic contacts without axial mechanical axles to open and close medium voltage electric contacts and to block and unblock automatic functioning of the electronic command, control and communication box.

6. The device according to claim 4, wherein the device is self-powered by a medium voltage network load current through a high-output nanocrystalline core CT supported by the photovoltaic cells that store energy in the supercapacitors bank to ensure the operation of the device even in the absence of power in the primary distribution line.

7. The device according to claim 1, wherein the insulation bushings and the polymeric box are manufactured using a resin injection process at high pressure.

8. A standalone device for overhead medium voltage electric distribution networks comprising:

a. a three-pole polymeric switch;
b. a polymeric base box; and
c. an electronic command, control and communication box, wherein the device is self-powered by a primary distribution line and installed at a potential;

wherein the device integrates protection, switching, fault indication and communication functions, wherein the electronic command, control and communication box is an air-tight metallic box that further comprises:

a. a blocking lever;
b. a command lever;
c. a connector;
d. an attachment pin;
e. a through-hole of the attachment pin;
f/ a first stud washer;
g. a second stud washer;
h. a status LED;
i. a blocking LED;
j. an operation LED;
k. an RF antenna;
l. an attachment eyelet;
m. a set of guides; and
n. a printed circuit board with an ultra-low power CPU, a 900 MHz radio communicator, and a supercapacitors bank; and wherein the attachment pin is actuated by the eyelet, allowing the electronic command, control and communication box to be installed and removed directly from land by a hot stick.

9. The device according to claim 8, wherein the three-pole polymeric switch comprises three insulation bushings, each insulation bushing further comprising:

a. an actuating and interrupting element;
b. terminals for electric current wires;
c. a connecting thread of the terminals;
d. an insulation silica sleeve;
e. an insulation fastening bushing;
f. a metering current transformer;
g. a self-power current transformer;
h. a main conducting axle'
i. command wires;
j. signal wires;
k. ducts for passing the command and signal wires; and
l. a set of screws for the polymeric base box.

10. The device according to claim 9, wherein the actuating and interrupting element a bi-stable closed field magnetic actuator connected to a vacuum interrupter, or a polymeric standalone element in which a bi-stable closed field magnetic actuator with interruption contacts is submitted to a vacuum environment.

11. The device according to claim 9, wherein the polymeric base box further comprises:

a. photovoltaic cells;
b. inserts for attaching the insulation bushings;
c. holes for passing the signal and command wires;
d. a cavity for attaching the electronic command, control and communication box;
e. an interconnecting electric connector; and
f. an attachment insert of the electronic command, control and communication box.

12. The device according to claim 8, wherein the blocking lever and the command lever are actuated by magnetic contacts without axial mechanical axles to open and close medium voltage electric contacts and to block and unblock automatic functioning of the electronic command, control and communication box.

13. The device according to claim 8, wherein the device is self-powered by a medium voltage network load current through a high-output nanocrystalline core CT supported by the photovoltaic cells that store energy in the supercapacitors bank to ensure the operation of the device even in the absence of power in the primary distribution line.

14. The device according to claim 9, wherein the insulation bushings and the polymeric box are manufactured using a resin injection process at high pressure.

* * * * *